US010577748B2

(12) United States Patent
Mauler et al.

(10) Patent No.: US 10,577,748 B2
(45) Date of Patent: Mar. 3, 2020

(54) TISSUE PAPER COMPRISING PULP FIBERS ORIGINATING FROM MISCANTHUS AND METHOD FOR MANUFACTURING THE SAME

(71) Applicant: SCA Hygiene Products AB, Göteborg (SE)

(72) Inventors: Dirk Mauler, Ilvesheim (DE); Peter Sandström, Solna (SE); Ingela Ljusegren, Floda (SE); Stefan Raum, Erding (DE)

(73) Assignee: ESSITY HYGIENE AND HEALTH AKTIEBOLAG, Göteborg (SE)

( * ) Notice: Subject to any disclaimer, the term of this patent is extended or adjusted under 35 U.S.C. 154(b) by 0 days.

(21) Appl. No.: 15/569,842

(22) PCT Filed: Apr. 29, 2015

(86) PCT No.: PCT/EP2015/059326
§ 371 (c)(1),
(2) Date: Oct. 27, 2017

(87) PCT Pub. No.: WO2016/173641
PCT Pub. Date: Nov. 3, 2016

(65) Prior Publication Data

US 2018/0127920 A1 May 10, 2018

(51) Int. Cl.
*D21H 27/38* (2006.01)
*D21H 27/00* (2006.01)
*D21H 27/30* (2006.01)

(52) U.S. Cl.
CPC ..... *D21H 27/005* (2013.01); *D21H 27/002* (2013.01); *D21H 27/30* (2013.01); *D21H 27/38* (2013.01)

(58) Field of Classification Search
USPC ..... 162/129
See application file for complete search history.

(56) References Cited

U.S. PATENT DOCUMENTS

| | | | |
|---|---|---|---|
| 5,312,522 | A | 5/1994 | Van Phan et al. |
| 5,397,435 | A | 3/1995 | Ostendorf et al. |
| 2009/0266500 | A1 | 10/2009 | Schubert et al. |
| 2015/0068693 | A1 | 3/2015 | D'Agnone |

FOREIGN PATENT DOCUMENTS

| | | | |
|---|---|---|---|
| CN | 1760445 | A | 4/2006 |
| CN | 1827910 | A | 9/2006 |
| CN | 101573490 | A | 11/2009 |
| CN | 104271834 | A | 1/2015 |
| DE | 10 2007 017 061 | A1 | 10/2008 |
| EP | 0 029 269 | A1 | 5/1981 |
| EP | 1 583 869 | B1 | 2/2008 |
| KR | 20150038853 | A | 4/2015 |
| WO | WO-94/10381 | A1 | 5/1994 |
| WO | WO-96/06223 | A1 | 2/1996 |
| WO | WO-2004/057109 | A1 | 7/2004 |

OTHER PUBLICATIONS

Schubert et al., DE 10 2007 017061, machine translation, Oct. 2008.*
Cappelletto et al., Papermaking pulps from fibrous fraction of Miscanthus Giganteous, International Crops and Products, vol. 11, pp. 205-210, Year 2000).*
Examination report No. 1 for standard patent application dated Apr. 20, 2018 in Australian Patent Application No. 2015393147.
Second Examination Report dated Mar. 12, 2019 in Chilean patent application No. 02700-2017 (7 pages) and its partial English-language translation thereof (1 page).
First Examination Report dated Oct. 10, 2018 in Chilean patent application No. 02700-2017 (8 pages) and its partial English-language translation thereof (2 pages).
Examination report No. 2 for standard patent application dated Aug. 29, 2018 in Australian patent application No. 2015393147.
Examination report No. 3 for standard patent application dated Jan. 8, 2019 in Australian patent application No. 2015393147.
Moroccan examination report dated Sep. 27, 2018 in Moroccan patent application No. 41084 (4 pages) and its partial English-language thereof (1 page).
Colombian Office Action Oficio N° 15270 dated Jan. 11, 2019 in Colombian patent application No. NC2017/0010865 (17 pages) and its English-language translation thereof (8 pages).
Cappelletto P. et al., "Papermaking pulps from the fibrous fraction of Miscanthus x Giganteus", International Crops and Products, 2000, vol. 11, pp. 205-210.
First Chinese Office Action dated Jun. 5, 2019 in Chinese patent application No. 201580079350.4 (8 pages) and its English-language translation thereof (8 pages).
Colombian Office Action Oficio N° 2308 dated May 8, 2019 in Colombian patent application No. NC2017/0010865 (13 pages) and its English-language translation thereof (7 pages).
Second Chinese Office Action dated Nov. 5, 2019 in Chinese patent application No. 201580079350.4 (9 pages) and its English-language translation thereof (9 pages).

(Continued)

*Primary Examiner* — Mark Halpern

(74) *Attorney, Agent, or Firm* — Drinker Biddle & Reath LLP

(57) ABSTRACT

A tissue paper web composed of one or more layers. At least one layer includes pulp fibers originating from at least one plant belonging to the genus *Miscanthus* wherein the pulp fibers are selected from chemical pulp fibers, mechanical pulp fibers subjected to a chemical pretreatment and mixtures thereof. The use of *Miscanthus* pulp fibers can lead to a major absolute increase in tensile strength along with good softness values.

17 Claims, 1 Drawing Sheet

(56) References Cited

OTHER PUBLICATIONS

Mexican Office Action No. Folio 90413 dated Oct. 29, 2019 in Mexican patent application No. MX/a/2017/013851 (3 pages) and its English-language translation thereof (2 pages).
Xingxiang Wang, Effect of Miscanthus Giganteus Semichemical Pulping Conditions on Some Pulp and Paper Properties, World Pulp and Paper, 2011, vol. 30(3): 19-24.

* cited by examiner

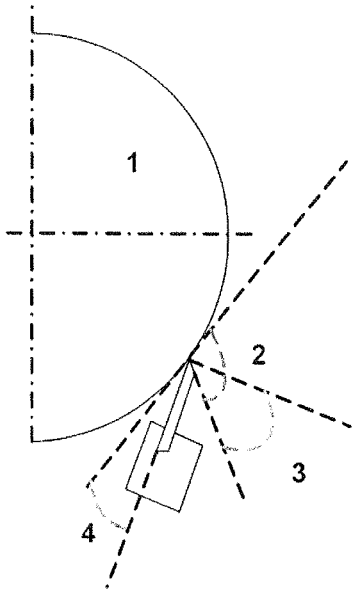
1
2
3
4
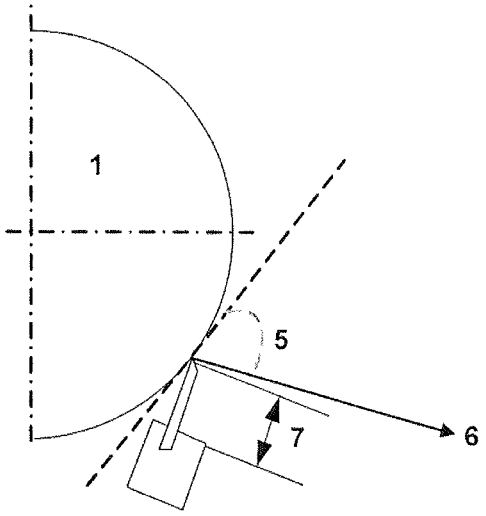
1
5
6
7

TISSUE PAPER COMPRISING PULP FIBERS ORIGINATING FROM MISCANTHUS AND METHOD FOR MANUFACTURING THE SAME

CROSS-REFERENCE TO PRIOR APPLICATION

This application is a § 371 National Stage Application of PCT International Application No. PCT/EP2015/059326 filed Apr. 29, 2015, which is incorporated herein in its entirety.

TECHNICAL FIELD

The present disclosure relates to a soft and strong tissue paper including fibers originating from a plant belonging to the genus *Miscanthus*, in particular from *Miscanthus giganteus*. The present disclosure also pertains to a process for the manufacture of said tissue paper as well as to products, e.g. toilet paper, hand towels, household towels etc., obtained by this process.

BACKGROUND

Tissue paper-based materials find extensive use in modern society. Toilet paper, paper towels such as hand towels or household (kitchen) towels, facial tissues and tissue handkerchiefs are staple items of commerce. These products are typically made from papermaking pulp including fibers of both hardwood and softwood types.

Among the most important physical properties of these products are their strength, their softness, their absorbency, primarily for aqueous systems, and their lint and dust resistance. These physical properties are generally tuned for addressing common consumer demand.

Tissue paper products are often exposed to extremely varied strength requirements in the wet and the dry state, respectively. For instance, it must be ensured, in the case of household paper (paper towels) that they retain their strength at least for a specific period of time when exposed to aqueous liquids or moisture-containing food. On the other hand, toilet paper should dissolve in water, sometime after use, in order to prevent the sewage systems from clogging up. Furthermore, toilet paper must not immediately lose its strength properties during use for apparent reasons.

At the same time, tactile properties such as softness are extremely important as tissue paper-based products are intended to come in intimate contact with the body and skin. Therefore, tissue paper-based products must exhibit sufficient softness in order to ensure consumer's comfort.

However, strength and softness are generally conflicting properties. If strength rises, the softness of the tissue paper will decline due to the increase of fiber to fiber bonds. Conversely, if softness increases, the strength is decayed due to limited fiber to fiber bonds.

The prior art describes many processes for achieving a good balance between strength and softness, or increasing one property without detrimentally affecting another.

EP 0 029 269 A1 discloses a multi-layered tissue paper, and tissue paper-based products made thereof, such as toilet tissue and facial tissues, having a smooth and soft top surface. The tissue paper comprises a velutinous top layer being the outwardly facing surface formed from at least 60% by weight of short hardwood fibers, such as Northern Hardwood Sulfite and/or Eucalyptus Hardwood, united to a furnish comprising long softwood fibers. The short papermaking fibers disposed on the outer layer exhibit sufficient free end portions to achieve softness, whereas the long-fiber furnish ensures strength. However, for some applications this tissue paper does not exhibit sufficient strength, primarily in the dry state.

Another common measure for modifying the strength and softness properties of tissue papers consists in adding strengthening and/or softening compositions to tissue-based materials. In this regard, the prior art describes strengthening resins, such as polyamidoamine-epichlorine resins. However, the isolated use of strengthening resins generally provides a tissue paper which is fairly stiff and has almost the haptic properties of normal paper. Consequently, strengthening resins are often used in combination with softening compositions which, in turn, reduce strength since softeners also interact with inter-fiber hydrogen bonds.

WO 94/10381 A1 discloses soft and strong tissue paper webs which can be used in toweling, napkin, facial tissue, and toilet tissue products. The tissue paper webs generally comprise a cellulose-based furnish, such as a mixture of Northern softwood kraft and eucalyptus fibers, and a chemical softening composition comprising a cationic surfactant as softener. However, surfactants weaken the bonds between fibers in the tissue webs. As a result, the tissue paper webs do not exhibit sufficient strength. The loss of strength due to the surfactant is hence compensated by the addition of a binding resin, such as a polyamidoamine-epichlorohydrin resin.

Likewise, U.S. Pat. Nos. 5,397,435 and 5,312,522 disclose tissue paper-based products such as paper towels, facial tissues and toilet tissues, comprising a combination of a chemical softening composition containing a surfactant such as a quaternary ammonium compound, and a strengthening resin such as a polyamide-epichlorohydrin resin. However, as outlined above, the use of softening and strengthening chemical compositions in combination generally does not provide a significant improvement, because the effect of one composition (e.g. softening or strengthening) is often compromised by the opposite effect caused by the other.

In addition, it can be desirable to reduce the amount of chemicals such as softening and/or strengthening chemical compositions in tissue paper. This applies primarily to cases where these chemical compositions tend to irritate the skin or trigger allergic reactions in some users. Furthermore, the biological degradability of some softening and/or strengthening chemical compositions in the environment has raised concerns.

WO 96/06223 A1 proposes a tissue sheet composed of northern softwood kraft and eucalyptus hardwood kraft, comprising a combination of "debonding" agents and strengthening agents added in a layer-wise fashion, in order to maximize the effectiveness of each additive while minimizing the interaction of the additives with each other. However, the addition of different chemical compositions in a layer-wise fashion significantly increases the complexity of the manufacturing process.

These are typical examples for the generally occurring problem in the art of tissue paper making that the above-mentioned properties conflict with each other in so far as attempts to improve one property is detrimental for another.

Further, it has been noted that, in tissue paper making processes, the primary (embryonic) fibrous webs containing eucalyptus pulp fibers sometimes do not show the desired strong adhesion to the Yankee cylinder when the web is subjected to the final drying and creping steps.

Starting from commonly used tissue paper products using mixtures of softwood and eucalyptus pulps, it is desired to provide tissue paper webs and products having improved properties, in particular improved strength and good softness.

It is also desired to provide a process for manufacturing such tissue paper webs. According to one aspect, a process is provided which involves an improved adhesion of the "primary" fibrous webs to the Yankee cylinder during the final drying and creping steps of the process.

SUMMARY

The present disclosure relates to a soft and strong tissue paper web composed of one or more layers wherein at least one of these layers includes pulp fibers originating from at least one plant belonging to the genus *Miscanthus*, in particular from *Miscanthus giganteus*. The present disclosure also relates to tissue paper products such as toilet paper, hand towels, household towels, handkerchiefs, napkins and facial tissues manufactured from said tissue paper web.

The present disclosure also relates to a process for the manufacture of a tissue paper web including:

(a) providing pulp fibers including fibers originating from at least one plant belonging to the genus *Miscanthus*, for example from *Miscanthus giganteus;*

(b) forming an aqueous suspension of the fibers;

(c) feeding the suspension to a tissue-making headbox;

(d) depositing the suspension onto a wire to form a wet web;

(e) dewatering the wet web; and (f) drying and creping the web,

The pulp fibers are selected from chemical pulp fibers, mechanical pulp fibers subjected to a chemical pretreatment, and mixtures thereof.

The tissue paper web and tissue paper products of embodiments of the present invention are distinguished by their excellent strength and good softness.

The present disclosure includes the following embodiments ("Items"):

1. Tissue paper web composed of one or more layers wherein at least one layer includes pulp fibers originating from at least one plant belonging to the genus *Miscanthus* wherein the pulp fibers are selected from chemical pulp fibers, mechanical pulp fibers subjected to a chemical pretreatment and mixtures thereof.

2. Tissue paper web according to Item 1 wherein the pulp fibers originate from *Miscanthus giganteus, Miscanthus Sinensis*, or *Miscanthus Sacchariflorus*, and in particular from *Miscanthus giganteus.*

3. Tissue paper web according to Item 1 or 2 wherein the pulp fibers, which originate from at least one plant belonging to the genus *Miscanthus*, for example from *Miscanthus giganteus*, are present in an amount of at least 5 wt.-%, in an amount of from 10 wt.-% to 90 wt.-%, in an amount of from 15 wt.-% to 80 wt.-%, or in an amount of 20 wt.-% to 70 wt.-%, based on the total weight of the tissue paper web.

4. Tissue paper web according to any of Items 1, 2 or 3 wherein the web is composed of two or three layers made from different pulps wherein at least one of these layers is made from pulp including the pulp fibers originating from at least one plant belonging to the genus *Miscanthus*, for example from *Miscanthus giganteus.*

5. Tissue paper web according to any of Items 1, 2, 3 or 4 wherein the remaining fibers present in said tissue paper web are selected from pulp fibers including hardwood fibers, such as eucalyptus, beech, aspen, acacia or birch fibers; softwood fibers such as pine, spruce, red cedar, hemlock, and larch fibers; and non-wood fibers such as cotton, bagasse, hemp, linen, sisal, straw or flax fibers.

6. Tissue paper web according to Item 4 or 5, wherein the web is composed of two layers wherein (i) the first layer is made from pulp fibers (i-a) consisting of fibers originating from at least one plant belonging to the genus *Miscanthus*, for example from *Miscanthus giganteus*, and optionally hardwood fibers, or from pulp fibers (i-b) comprising, or consisting of, fibers originating from at least one plant belonging to the genus *Miscanthus*, for example from *Miscanthus giganteus*, softwood fibers, and optionally hardwood fibers, and (ii) a second layer is made from pulp fibers comprising or consisting of softwood fibers.

7. Tissue paper web according to Item 6, wherein (i) the first layer is made from pulp fibers (i-a), wherein the weight ratio of fibers originating from at least one plant belonging to the genus *Miscanthus*, for example from *Miscanthus giganteus*, to hardwood fibers, if present, is 100/0 to 10/90, or 100/0 to 20/80, and (ii) the second layer is made from pulp comprising, or consisting of, softwood fibers, and wherein the weight proportion of pulp fibers originating from at least one plant belonging to the genus *Miscanthus*, for example from *Miscanthus giganteus*, based on the total weight of the tissue paper web is in particular embodiments 10 to 90 wt.-%, 10 to 80 wt.-%, 25 to 75 wt.-%, or 40 to 70 wt.-%.

8. Tissue paper web according to Item 6, wherein (i) the first layer is made from pulp fibers (i-b) consisting of fibers originating from at least one plant belonging to the genus *Miscanthus*, for example from *Miscanthus giganteus* (MG), softwood fibers (SW), and optionally hardwood fibers (HW), wherein the weight ratio MG/HW/SW in %, based on the total weight of pulp fibers (i-b), is 10 to 90/0 to 50/10 to 90, or 20 to 80/0 to 50/20 to 80, and (ii) the second layer is made from pulp fibers comprising, or consisting of, softwood fibers, and wherein the weight proportion of pulp fibers originating from at least one plant belonging to the genus *Miscanthus*, for example from *Miscanthus giganteus*, based on the total weight of the tissue paper web is in particular embodiments 10 to 50 wt.-%, or 10 to 30 wt.-%.

9. Tissue paper web according to any of Items 1, 2, 3, 4, 5, 6, 7 or 8, wherein the pulp fibers originating from *Miscanthus giganteus* are obtained in a chemical, chemomechanical or high yield chemical pulping process, for example the soda process or the CTMP process (Chemo-Thermo-Mechanical Pulping).

10. Tissue paper web according to any of Items 1, 2, 3, 4, 5, 6, 7, 8 or 9, wherein the hardwood pulp fibers originate from eucalyptus and/or the softwood pulp fibers are Northern Bleached Softwood Kraft (NBSK) fibers, wherein the NBSK fibers are in particular embodiments refined to a degree of fineness of 19 to 35°SR.

11. Tissue paper web according to any of Items 1, 2, 3, 4, 5, 6, 7, 8, 9 and 10, wherein (i) all fibers present in the web are primary pulp fibers, or (ii) a mixture of primary and secondary (recycled) pulp fibers wherein the proportion of secondary (recycled) pulp fibers does not exceed 90 wt.-% based on the tissue paper web.

12. Tissue paper web according to any of Items 1, 2, 3, 4, 5, 6, 7, 8, 9, 10 or 11 which is composed of one or more layers wherein the pulp fibers originating from at least one plant belonging to the genus *Miscanthus* fulfill the following requirements:

(i) average fiber length of from 0.5 to 1.2 mm, or from 0.8 to 1.0 mm;

(ii) average fiber diameter of from 10 to 25 μm; and (iii) average fiber wall thickness of from 3.0 to 5.0 μm.

13. Tissue paper product including at least one ply made from the tissue paper web according to any of Item 1, 2, 3, 4, 5, 6, 7, 8, 9, 10, 11 or 12.

14. Tissue paper product according to Item 13, wherein the tissue paper product is selected from toilet paper, hand towel, household towel, handkerchiefs, napkins and facial tissues.

15. Tissue paper product according to Item 13 or 14 wherein the tissue paper product is a toilet paper composed of 2 to 4 plies, wherein in particular embodiments at least one outer ply, or both outer plies, is/are made from the tissue paper web of Item 7, and the outer ply/plies is/are arranged such that, in the toilet paper, the first layer thereof (i), which includes the pulp fibers originating from at least one plant belonging to the genus *Miscanthus*, for example from *Miscanthus giganteus*, is located on the outer surface of the toilet paper.

16. Tissue paper product according to Item 13 or 14 wherein the tissue paper product is a hand towel or household towel composed of 2 to 4 plies, wherein in particular embodiments at least one ply, optionally all plies, is/are made from the tissue paper web of Item 7 or the tissue paper web of Item 8.

17. Tissue paper product according to any of Items 13, 14, 15 or 16 wherein the tissue paper product is free of a softener and/or is free of a strengthening resin.

18. Process for the manufacture of a tissue paper web according to any of Items 1, 2, 3, 4, 5, 6, 7, 8, 9, 10, 11 or 12, including:

(a) providing chemical pulp fibers including fibers originating from at least one plant belonging to the genus *Miscanthus*, for example from *Miscanthus giganteus;*

(b) forming an aqueous suspension of said pulp fibers;

(c) feeding the suspension to a tissue-making headbox;

(d) depositing the suspension onto a wire to form a wet web;

(e) dewatering the wet web; and (f) drying and creping the web.

Where the present description refers to "preferred" embodiments/features, combinations of these "preferred" embodiments/features shall also be deemed as disclosed as long as this combination of "preferred" embodiments/features is technically meaningful.

Hereinafter, the use of the term "comprising" should be understood as disclosing, as a more restricted embodiment, the term "consisting of" as well.

FIGURES

FIG. 1—Schematic drawing showing the creping process on a Yankee cylinder with a creping blade. FIG. 1 gives a survey on the terminology used for the various angles influencing the creping process. In FIG. 1 the following reference numbers represent:

(1) Yankee cylinder, (2) Crepe pocket angle, (3) Bevel angle, (4) Blade holder angle, (5) Sheet take-off angle, (6) Creped sheet, and (7) Stick out.

DETAILED DESCRIPTION OF PARTICULAR EMBODIMENTS

1. Tissue Paper Web

The tissue paper web of the present disclosure is composed of one or more layers wherein at least one layer comprises pulp fibers originating from at least one plant belonging to the genus *Miscanthus.*

The term "tissue paper" as used herein covers the "base (raw) tissue paper" ("tissue paper web") as obtained from the tissue paper machine as well as one-ply or multi-ply final products ("tissue paper products") made of base tissue, and tailored to the end user's needs by further converting steps.

As used herein the term "tissue paper web" means the one-ply base tissue as obtained from the tissue machine. The tissue paper web is a sheet of paper made by a process comprising the steps of: forming an aqueous suspension of pulp fibers i.e. the so-called "furnish", depositing said aqueous suspension onto a wire to form a wet web, dewatering, drying and creping the web.

The tissue paper web has a basis weight of 8 to 50 g/m$^2$, in particular 10 to 30 g/m$^2$, especially 12 to 25 g/m$^2$.

The tissue paper web of the present disclosure is composed of one or more layers (i.e. single-layered web or multi-layered web). As used herein the term "layer" refers to a stratum within the web having a defined fiber composition. The one or more layers is/are formed by depositing one or more streams of pulp furnishes onto a wire with a pressurized single- or multi-layered headbox. This technique is well-known to those skilled in the art. It renders possible the use of different kinds of fibers in each layer of the web. The "multi-layered" tissue paper web of the present invention may have 2 to 5, typically 2 or 3 layers.

The term "ply" as used herein refers to the one or more plies of tissue paper in the final tissue paper product as are obtained after processing ("converting") one or more base tissue paper webs. Each individual ply consists of a tissue paper web comprising one or more layers, e.g. one, two, three or four layers.

Based on the underlying compatibility of the production processes (wet forming), "tissue" production is counted among the papermaking techniques. The production of tissue is distinguished from paper production by its extremely low basis weight and its much higher tensile energy absorption index.

The tensile energy absorption index is arrived at from the tensile energy absorption in which the tensile energy absorption is related to the test sample volume before inspection (length, width, thickness of sample between the clamps before tensile load). Paper and tissue paper also differ in general with regard to the modulus of elasticity that characterizes the stress-strain properties of these planar products as a material parameter.

A tissue's high tensile energy absorption index results from the outer or inner creping. The former is produced by compression of the paper web adhering to a dry cylinder as a result of the action of a crepe doctor or in the latter instance as a result of a difference in speed between two wires ("fabrics"). This causes the still moist, plastically deformable paper web to be internally broken up by compression and shearing, thereby rendering it more stretchable under load than an uncreped paper. A high tensile energy absorption index can also be achieved by imparting to the tissue a 3D structure by means of the wires themselves. Most of the functional properties typical of tissue and tissue products result from the high tensile energy absorption index (see DIN EN 12625-4 and DIN EN 12625-5).

Typical properties of tissue paper include the ready ability to absorb tensile stress energy, their drapability, good textile-like flexibility, properties which are frequently referred to as bulk softness, a high surface softness, a high specific volume with a perceptible thickness, as high a liquid absorbency as possible and, depending on the application, a suitable wet and dry strength as well as an interesting visual appearance of the outer product surface. These properties allow tissue paper to be used, for example, as cleaning cloths (e.g. household towels), sanitary products (e.g. toilet paper, hand towels), paper handkerchiefs, cosmetic wipes (facial tissues) or as serviettes/napkins.

The tissue paper web of embodiments of the invention and the tissue paper products made therefrom are characterized by their content of pulp fibers originating from at least one plant belonging to the genus *Miscanthus*.

The "*Miscanthus*" genus includes about 15 perennial rhizomatous grasses. *Miscanthus* grasses are usually found throughout a wide climatic range, from the tropics and subtropics to the temperate regions of Northern Asia and Europe. The fibers can be selected from fibers originating from the species *Miscanthus Floridulus, Miscanthus Sacchariflorus, Miscanthus Sinensis, Miscanthus giganteus, Miscanthus Tinctorius*, and *Miscanthus Transmorrisonensis*.

In particular embodiments, the pulp fibers originate from *Miscanthus* Sacchariflorus, *Miscanthus Sinensis*, and *Miscanthus giganteus*. In more particular embodiments, the pulp fibers originate from *Miscanthus giganteus*.

When the aforementioned pulp fibers originating from at least one plant belonging to the genus *Miscanthus* are used to form the tissue paper web, the resulting tissue paper web/product exhibits improved properties, in particular improved strength and good softness. When pulp fibers originating from *Miscanthus giganteus* are used, the improvement of strength is even more pronounced while good softness is maintained.

Further, when the aforementioned pulp fibers originating from at least one plant belonging to the genus *Miscanthus* are used to form the tissue paper web, the resulting tissue paper web/product exhibits excellent absorption for aqueous systems.

It is furthermore believed that the tissue paper web/product comprising pulp fibers originating from at least one plant belonging to the genus *Miscanthus*, can exhibit antimicrobial/antibacterial properties which are natural attributes of plants belonging to the genus *Miscanthus*.

The tissue paper web of embodiments of the present invention contains the aforementioned pulp fibers originating from at least one plant belonging to the genus *Miscanthus* in an amount of at least 5 wt.-%, in an amount of at least 10 wt.-%, in an amount of from 10 wt.-% to 80 wt.-%, or in an amount of from 20 wt.-% to 70 wt.-%, based on the total weight of the tissue paper web.

The "pulp fibers" are selected from chemical pulp fibers, mechanical pulp fibers subjected to a chemical pretreatment and mixtures thereof.

"Chemical pulps" are, according to DIN 6730, fibrous materials obtained from plant raw materials of which most non-cellulosic components have been removed by chemical pulping without substantial mechanical post treatment.

Use can also be made of mechanical pulps subjected to chemical pretreatment, such as chemo-mechanical pulp (CMP pulp), or chemo-thermo-mechanical pulp (CTMP pulp).

According to one embodiment, the tissue paper web and tissue paper products do not include fibrous material made from wood entirely by mechanical means, i.e. purely mechanical pulps such as groundwood pulp and refined mechanical pulp.

The pulp fibers originating from at least one plant belonging to the genus *Miscanthus* can be obtained in a chemical, chemo-mechanical (CMP) or high yield chemical pulping process. The use of alkaline chemical pulping or pretreatment processes can be particularly useful. The pulp fibers can be obtained by employing the soda pulping process or the CTMP process (Chemo-Thermo-Mechanical Pulping) as described e.g. by P. Cappelletto et al. in *Industrial Crops and Products,* 11 (2000) 205-210. The pulp fibers can be obtained by the soda pulping process. Kraft cooking could be used as well.

Further, the pulp fibers originating from at least one plant belonging to the genus *Miscanthus* can be prepared and/or treated by common techniques. For instance, said pulp fibers can be bleached by using chlorine-free bleaching steps in view of the production of environmentally sound products and process steps.

According to one embodiment, the pulp fibers originating from at least one plant belonging to the genus *Miscanthus*, for example from *Miscanthus giganteus*, have a length of from 0.5 to 1.2 mm, or from 0.8 to 1.0 mm, a diameter of from 10 to 25 μm, e.g. 13 to 21 μm, or 13 to 15 μm, and a wall thickness of from 3.0 to 5.0 μm. The fiber dimensions are mean (average) values, which can be determined by techniques well-known in the art such as described by C. Ververis et al. in *Industrial Crops and Products* 19 (2004) 245-254.

In the following, for the sake of brevity, we will refer to pulp fibers originating from at least one plant belonging to the genus *Miscanthus*, for example from *Miscanthus giganteus*", and being selected from chemical pulp fibers, mechanical pulp fibers subjected to a chemical pretreatment and mixtures thereof as "MG pulp fibers".

According to one embodiment, the tissue paper web is composed of two or three layers made from different pulps wherein at least one of these layers is made from pulp comprising MG pulp fibers.

According to one further embodiment, the remaining fibers present in the tissue paper web, i.e. the fibers being not MG pulp fibers, are selected from pulp fibers comprising hardwood fibers, such as eucalyptus, beech, aspen, acacia or birch fibers; softwood fibers such as pine, spruce, red cedar, douglas fir, hemlock, and larch fibers; and non-wood fibers such as cotton, bagasse, hemp, linen, sisal, straw or flax fibers.

As used herein "hardwood fibers" means fibrous pulp derived from the woody substance of deciduous trees (angiosperms). Typically, hardwood fibers are "short" fibers having a length of from 1 to 2 mm, a diameter of from 15 to 30 μm, and a wall thickness of from 2 to 3 μm. Hardwood such as Eucalyptus is normally pulped by the Kraft process.

The hardwood fibers usable herein can originate from eucalyptus, beech, aspen, acacia and birch, or in particular from eucalyptus.

As used herein "softwood fibers" means fibrous pulp derived from the woody substance of coniferous trees (gymnosperms). Typically, softwood fibers are "long" fibers having a length of from 3 to 4 mm, a diameter of from 30 to 40 μm, and a wall thickness of from 3 to 4 μm. They are normally pulped by the Kraft process.

The softwood fibers usable herein can originate from pine, spruce, red cedar, douglas fir, hemlock, and larch. In particular embodiments, the softwood fibers are Northern Bleached Softwood Kraft (NBSK) fibers. In certain embodiments, at least part of the NBSK fibers to be used is refined, for example to a degree of fineness of 19 to 35°SR, e.g. 19 to 26°SR.

As used herein "non-wood fibers" means fibrous pulp derived from the non-woody substance of plants such cotton, bagasse, hemp, linen, sisal, straw or flax.

According to one particular embodiment, the tissue paper web is composed of two layers wherein (i) the first layer is made from
  (i-a) pulp fibers consisting of MG pulp fibers, and optionally hardwood fibers, or
  (i-b) from pulp fibers comprising, or consisting of, MG pulp fibers, softwood fibers, and optionally hardwood fibers, and
(ii) a second layer is made from pulp fibers comprising, or consisting, of softwood fibers.

Although it is frequently preferred that the second layer is made from pulp fibers consisting (only) of softwood ("SW") fibers this layer can also be made from pulp fibers comprising softwood fibers and other pulp fibers such as MG pulp fibers and/or hardwood fibers and/or non-wood fibers such as bagasse fibers or the other fibers mentioned hereinbefore. These other pulp fibers can be used in an amount of up to 60 wt.-% based on the total weight of pulp fibers being present in the second layer.

Considering an exemplary case of 80% MG pulp fibers in total, one may for instance split the furnish for technical reasons in 50% MG pulp fibers in the first layer while the second layer consists of 30% MG pulp fibers plus 20% SW pulp fibers, each based on the total weight of the tissue paper web. In an alternative embodiment, 50% MG pulp fibers are used in first layer and 30% Eucalyptus plus 20% SW pulp fibers in the second layer.

The above also applies to the following embodiments where the second layer is made from pulp comprising, or consisting of, softwood fibers.

According to one particular embodiment, especially suitable for the manufacture of toilet tissue paper, the tissue paper web is composed of two layers wherein (i) the first layer is made from pulp fibers consisting of MG pulp fibers, and optionally hardwood fibers,
  (i-a) wherein the weight ratio of MG pulp fibers to hardwood fibers, if present, is 100/0 to 20/80, and
(ii) the second layer is made from pulp comprising, or consisting of, softwood fibers, and wherein the weight proportion of MG pulp fibers based on the total weight of the tissue paper web can be 10 to 80 wt.-%, 25 to 75 wt.-%, or 40 to 70 wt.-%.

According to one embodiment, especially suitable for the manufacture of household towel and hand towel, the tissue paper web is composed of two layers wherein (i) the first layer is made from
  (i-b) pulp fibers consisting of MG pulp fibers, softwood fibers (SW), and optionally hardwood fibers (HW), wherein the weight ratio MG/HW/SW in %, based on the total weight of pulp fibers (i-b), is 10 to 90/0 to 50/10 to 90, 20 to 80/0 to 50/20 to 80, e.g. 20 to 70/10 to 50/20 to 70, or 20 to 80/0/20 to 80 or 20 to 50/0 to 30/40 to 60, and
(ii) the second layer is made from pulp fibers comprising, or consisting of, softwood fibers, and wherein the weight proportion of MG pulp fibers based on the total weight of the tissue paper web is preferably 10 to 50 wt.-%, or 10 to 30 wt.-%.

The MG pulp fibers can be refined fibers or in particular embodiments unrefined fibers. The remaining fibers present in the tissue paper web (i.e. the fibers being not MG pulp fibers) can be unrefined fibers, refined fibers and mixtures thereof. In particular embodiments, at least a part of the softwood fibers (i.e. long fibers) to be used, optionally all softwood fibers, are refined. In particular embodiments, the hardwood fibers (i.e. short fibers) to be used are unrefined.

According to one embodiment, the hardwood pulp fibers originate from eucalyptus and/or the softwood pulp fibers are Northern Bleached Softwood Kraft (NBSK) fibers, wherein the NBSK fibers can be refined to a degree of fineness of 19 to 35°SR, in particular 19 to 26°SR, e.g. 19 to 24°SR.

As used herein "unrefined fibers" means fibers as naturally occurring or being obtained by their respective preparation process (chemical or mechanical pulping, recycling etc.). Although being dependent on the fiber source, unrefined hardwood and softwood pulp fibers typically have a freeness value of about 12 to 15°SR. By contrast, unrefined MG pulp fibers (as coming from the pulp mill) can have a SR value in the range of 34 to 36°SR, typically about 35°SR. The unrefined fibers used in the tissue paper web and product usually stem from hardwood. Also MG pulp fibers are typically used as they come from the paper mill without further refining. However, the unrefined fibers to be used can also stem from softwood, e.g. softwood like spruce digested by sulfite processes.

As used herein "refined fibers" means fibers which have been subjected to refining processes. Such processes are well known to those skilled in the art. Refined fibers typically have a freeness value of more than 15 to less than 35°SR. In particular embodiments, the softwood fibers are refined to a degree of fineness of 19 to 35°SR, 19 to 26°SR, or 19 to 24°SR. The refined fibers usually stem from softwood.

If long refined fibers and unrefined fibers are to be combined, be it in a single-layered ply as a true mixture or in multi-layered plies based on separate pulp streams, they can be used in a ratio of from 90/10 to 10/90, 80/20 to 20/80, or from 75/25 to 40/60.

Further, the pulp fibers present in the tissue paper web can be a primary fibrous material, a secondary fibrous material (recycled pulp) and mixtures thereof.

According to one embodiment, (i) all fibers present in the tissue paper web are primary pulp fibers, or (ii) a mixture of primary and secondary (recycled) pulp fibers. In particular embodiments, the proportion of secondary (recycled) pulp fibers, if present, does not exceed 90 wt.-%, based on the total weight of the tissue paper web. In certain embodiments, the proportion thereof is 70 wt.-% or less, e.g. 50 wt.-% or less.

As used herein "primary pulp fibers" means fibers as obtained from the pulping process of woody substances (e.g. hardwood, softwood) and non-woody substances (e.g. cotton, bagasse, hemp, *Miscanthus* etc.) which have not previously been used in a manufacturing process.

As used herein "secondary pulp fibers" means fibers that have previously been used in a manufacturing process (e.g. paper- or tissue-making), and have been reclaimed (recycled) as raw material for the process. Secondary pulp fibers can be recycled from e.g. waste paper by common techniques in the art.

The tissue paper web may include softening and/or strengthening chemical compositions.

In one embodiment, the tissue paper web is free of softener (debonder). In one further embodiment, the tissue paper web is free of strengthening chemical additives, such as strength resins, for instance free of the water-soluble cationic or anionic polymers described below. The tissue paper web can also be free of both softener (debonder) and strengthening chemical additives.

When the tissue paper web includes a softener and/or a strengthening resin, a water-soluble cationic polymer, a water soluble anionic polymer and/or a cationic surfactant-based softener as described, e.g. in European patent EP 1 583 869 B1 can be used.

1.a Water-Soluble Cationic Polymer

When a water-soluble cationic polymer is used, it is possible to add the same to the pulp fibers in such an amount that 0.01 to 5 wt.-%, 0.01 to 3 wt.-%, or 0.5 to 2 wt.-% (e.g. 0.5 to 1.5 wt.-%), based on the total amount of fibers (dry weight, EN 20638:1993) is retained.

The cationic polymer to be used contains cationic groups, such as positively charged quaternary nitrogen atoms in sufficient amounts to impart the molecule water solubility. The term "water-soluble" means solubility in water (at 20° C.) of at least 1 g/l, at least 10 g/l, or at least 20 g/l.

In a particular embodiment, the cationic water-soluble polymer is a wet strength agent. It can be selected from, but is not limited to, urea-formaldehyde resins, melamine-formaldehyde resins, polyvinylamine, polyureide-formaldehyde resins, glyoxal-acrylamide resins and cationic materials obtained by the reaction of polyalkylene polyamines with polysaccharides such as starch and various natural gums, as well as 3-hydroxyazetidinium ion-containing resins, which are obtained by reacting nitrogen-containing polymers with epichlorohydrine. Suitable materials are described in further detail in U.S. Pat. No. 3,998,690 and EP 1 583 869 B1.

In particular embodiments, the types of cationic polymer are 3-hydroxy azetidinium ion-containing resins. They include, but are not limited to, neutral or alkaline-curing thermosetting wet strength resins which can be selected from polyaminoamide-epichlorohydrine resins, polyamine-epichlorohydrine resins and aminopolymer-epichlorohydrine resins. Examples of these are the well-known Kymene® resins available from Ashland.

1.b Water-Soluble Anionic Polymer

When a water soluble anionic polymer is used, it can be added to the cellulosic fibers in such an amount that 0.01 to 3 wt.-%, 0.1 to 2 wt.-%, or 0.2 to 1 wt.-%, based on the total amount of untreated cellulosic fibers (dry weight according to DIN EN 20638) is retained by the fibers.

As used herein "water-soluble anionic polymers" means those polymers having a sufficient amount of anionic groups, such as carboxy groups to be water soluble.

As used herein "water-soluble" means solubility in water (at 20° C.) of at least 1 g/l, at least 10 g/l, or at least 20 g/l.

The water soluble anionic polymer can be selected among known anionic dry strength agents. Suitable dry strength agents are described in European patent EP 1 583 869 B1.

The water soluble anionic polymer can be selected from polycarboxylic acids and anhydrides such as starch-based polymers, (meth)acrylic acid-derived polymers and copolymers, maleic-anhydride-derived copolymers, vinyl copolymers of carboxylic acids and cellulose-based polymers. Starch-based polymers, vinyl copolymers of carboxylic acids and cellulose-based polymers are preferred. Among these, the use of carboxyalkylated polysaccharides, in particular carboxyalkylated cellulose, is most preferred.

The water-soluble carboxyalkylated polysaccharides include carboxymethyl cellulose (CMC), carboxymethyl hydroxycellulose (CMHEC), carboxymethyl hydroxypropylcellulose (CMHPC), carboxymethylguar (CMG), carboxymethylated locust bean gum, carboxymethyl starch and the like, and their alkali metal salts or ammonium salts.

The above anionic polymers also include anionic polymers of acrylamide. These can be made by hydrolysis of an acrylamide polymer or copolymer by means known to the art, or by copolymerizing acrylamide with acrylic acid or sodium acrylate and optionally another monomer under radical initiation, again by means known to the art. Also operable are poly(acrylic acid) or its salts such as sodium polyacrylate or ammonium poylacrylate. Other operable polymers in this group are poly(acrylic acid) and its salts, and poly(sodium acrylate).

Use can be made of commercially available anionic polymers, having carboxyl (or carboxylate salt) contents of about 0.5 to about 14 millequivalents per gram such as CMC.

The above-explained water soluble cationic polymer is used in higher amounts than the water soluble anionic polymer. In particular embodiments, the weight ratio cationic polymer/anionic polymer is from 1/1 to 10/1, 2/1 to 7/1, or 3/1 to 5/1.

1.c Cationic Surfactant-Based Softener

According to one embodiment, the tissue paper web/product is free of softening chemical additives (e.g. softener/debonder).

When a softener is used, a cationic surfactant-based softener (in the prior art sometimes referred to as "debonder") can be added to the cellulosic fibers in such an amount that 0.005 to 3 wt.-%, 0.01 to 2.5 wt.-%, or 0.5 to 2 wt.-%, based on the total amount of untreated cellulosic fibers (dry weight according DIN EN 20638) are retained by the fibers.

The softener may be selected from quaternary ammonium compounds (e.g. quaternized protein compounds, silicone quaternaries or quaternized protein compounds) or cationic phospholipids of the type as described in WO 97/04171. All suitable surfactant-based softeners have the presence of a cationic unit (for example quaternary ammonium unit) and a long chain aliphatic group having 8 to 24, or 14 to 22 carbon atoms in common. The long chain aliphatic group can be directly linked to the cationic group.

The quaternary ammonium compounds can also be selected from those conforming to Formula I, II, III, IV or V disclosed in [0079] to [0091] of EP 1 583 869 B1.

2. Tissue Paper Product

The present disclosure also relates to a tissue paper product comprising at least one ply made from the tissue paper web.

To achieve the desired finished products such as toilet tissues and hand towels, the one ply base tissues with typical basis weights from 12 g/m$^2$ to 38 g/m$^2$ are combined in a subsequent converting step to the final ply count which may be 2 to 5 depending on the targeted properties of the final tissue paper product.

In particular embodiments, the total basis weight of multiple-ply tissue products does not exceed 75 g/m$^2$ or is lower than 65 g/m$^2$, e.g. lower than 55 g/m$^2$.

In order to optimally use its strength and softness properties, it is desirable to employ the tissue paper web, i.e. one comprising MG pulp fibers, in one or both outer plies of the final tissue product, since these come in contact with the body and skin of the user.

When the tissue paper web is multi-layered, it is desirable that the outer layer(s) of the outer ply/plies, i.e. the layers which come into contact with the user's body and skin, comprise MG pulp fibers. A tissue paper product distinguished by its excellent strength and good softness is thus produced.

The tissue paper product can be selected from toilet paper, hand towel, household towel, handkerchiefs, serviettes/napkins and facial tissues.

According to one embodiment, the tissue paper product is a toilet paper composed of 2 to 5 plies, e.g. 2 to 4 plies, wherein at least one outer ply, or both outer plies, is/are made from the tissue paper web.

In a particular embodiment, a tissue paper web has a first layer (i) and a second layer (ii), which was stated to be especially suitable for the manufacture of toilet tissue paper and can be used in least one outer ply, for example both outer plies of a toilet paper having e.g. 2, 3, 4 or 5 plies.

In this product, the outer ply/plies can be arranged such that, in the toilet paper, the first layer thereof (i), which comprises the MG pulp fibers is located on the outer surface of the toilet paper. As a result, improved strength and soft feeling when applied on the user's skin can be achieved.

According to one further embodiment, the tissue paper product is a hand towel or household towel composed of 2 to 5, e.g. 2 to 4 plies. In a particular embodiment, at least one ply, optionally all plies, is/are made from the tissue paper web.

In a particular embodiment, a tissue paper web has a first layer (i) and a second layer (ii), which was stated to be especially suitable for the manufacture of hand towel or household towel and can be used in least one outer ply, or both outer plies of a hand towel having e.g. 2, 3, or 4 plies or household towel having e.g. 2, 3, 4 or 5 plies.

According to one further embodiment, the tissue paper product (e.g. toilet paper, hand towel and household towel) is free of a softener and/or is free of a strengthening additive, e.g. resin.

3. Process for the Manufacture of Tissue Paper Webs and Tissue Paper Products The present disclosure also relates to a process for the manufacture of a tissue paper web as described before and below, the process includes:

(a) providing pulp fibers comprising fibers originating from at least one plant belonging to the genus *Miscanthus*, for example from *Miscanthus gigantheus* i.e. MG pulp fibers;

(b) forming an aqueous suspension of said pulp fibers;

(c) feeding the suspension to a tissue-making headbox;

(d) depositing the suspension onto a wire to form a wet web;

(e) dewatering the wet web; and (f) drying and creping the web.

(a) The pulp fibers to be used in the aforementioned process can be prepared by common techniques known in the art, for instance, fractionating, sorting, washing, floating, cleaning, thickening and/or fiberizing.

When refined pulp fibers are to be used in the aforementioned process, said fibers can be refined by using techniques well-known in the art. Typically, the fibrous material to be refined is transported to a refiner unit. Fibrillation of fibers during refinement (beating) occurs either by the fibers themselves or by the refining bars. During refinement, the fibers are subjected to a variety of physical loads. Axial and tangential shearing and compressive forces acting upon the fiber play a particular role as regards fiber refining. The associate change in fiber morphology involves, but is not limited to, tearing open and removing the fibrous materials' outer wall layer (primary wall) and/or exposing the fibers and fibrillation out of the wall layers and/or partially shorting the total fiber unit and/or shearing off fibrils.

(b) After providing the pulp fibers comprising MG pulp fibers, an aqueous suspension is produced therefrom. The aqueous suspension may contain the pulp fibers in an amount of from 3 to 4 wt.-%, based on the water content. The aqueous suspension is then diluted to consistencies in the order of 0.5 to 1.5 wt.-%, or of 0.8 to 1.2 wt.-%.

In one embodiment, the aqueous suspension can be treated with the anionic and cationic water soluble polymer described before. In particular embodiments, aqueous solutions are used for adding these chemicals but it is also possible to add them in substance.

Generally, in particular embodiments the anionic polymer is added first (prior to the cationic polymer) in order to ensure an optimal interaction with the cellulosic fibers, if these chemicals are to be added. After a period of time of for example 30 seconds to 24 hours, or 1 to 30 minutes, the cationic polymer is also given to the aqueous slurry. Again, in particular embodiments a certain period of time is allowed to pass (for example from 1 to 30 minutes) before the aqueous slurry is conducted to the headbox and dewatered. A different order of addition can also be used as described in EP 1 583 869 B1.

(c) In step (c), the suspension is fed to a tissue-making headbox in line with methods known in the art. In a typical process, a low consistency pulp furnish is provided in a pressurized (e.g. multi-layered) headbox. The headbox has an opening for delivering a thin deposit of pulp furnish onto the Fourdrinier wire to form a wet web in the following step (d) in which the suspension is deposited onto a wire to form a wet web. According to one embodiment, softness and strength of the base tissue are influenced by producing a multi-layer tissue paper web if a specifically constructed headbox (i.e. multi-layered headbox) is used to form the primary fibrous web having physically different layers of fibrous material.

(d) The wet laying step and the further production steps are also performed in line with methods known in the art. Tissue paper can be formed by placing the fibers on one or between the two continuously revolving wires of the papermaking machine while simultaneously removing the main quantity of water of dilution until dry-solids contents of 8 to 35% are obtained.

The forming wire is often referred to in the art as a Fourdrinier wire. Once the furnish is deposited on the forming wire, it is referred to as a web. The particular techniques and equipment for making webs according to the process just described are well-known to those skilled in the art.

(e) The web is then typically dewatered to a fiber consistency of between about 8% and about 35% (total web weight basis) by gravity or vacuum dewatering, and further dewatering the web by pressing operations wherein the web is subjected to pressure developed by opposing mechanical members, for example cylindrical rolls. A shoe press such as the NipcoFlex-T available from Voith can be used for the pressing operations.

(f) In conventional tissue making processes, the formed primary fibrous web is dried in one or more steps by mechanical and thermal means until a final dry-solids content of usually about 93 to 97% is obtained. The drying is followed by the crepe process which crucially influences the properties of the finished tissue product. The creping step involves creping on a usually 4.5 to 6 m diameter drying cylinder, the so-called Yankee cylinder, by means of a crepe doctor with the aforementioned final dry-solids content of the base tissue paper (wet creping can be used if lower demands are made of the tissue quality). The creped, finally dry base tissue paper (base tissue) is then available for further processing into the tissue paper product.

When the tissue paper is creped on the Yankee cylinder, the blade holder angle (reference number (4) in FIG. 1) can be determined to be from 10 to 35°. In conventional tissue making processes, values of from 11 to 13° are typically employed. If through-air-drying (TAD) technology as explained below is used, the blade holder angle may be from 20 to 35°, or 22 to 30°.

The geometry of the doctor blade relative to the tissue surface may also have an impact on the properties of the product obtained. Thus, thickness and relative wet strength may increase, when the bevel angle is increased from 20° over 25° to 30°. As used herein "level angle" means the angle (3) given in FIG. 1.

The inventors have surprisingly found that in the present tissue paper making processes, the primary (embryonic) fibrous webs containing MG pulp fibers strongly adheres to the Yankee cylinder in the final drying and creping steps. Furthermore, the inventors have observed that due to the strong adhesion of the web to the Yankee cylinder, finer creping is achieved and a smoother tissue surface is obtained. The strong and controlled adhesion of the web to the Yankee cylinder generally facilitates the tissue paper making process.

Instead of the conventional tissue making process described above, the invention can also make use of a modified technique in which an improvement in specific volume is achieved through wet-shaping of the still wet primary (embryonic) fibrous web by means of a 3D-structured fabric or plastic belt and/or by a special kind of drying as in TAD processes. In this way, an improvement in the bulk softness of the thus made tissue paper is achieved as well. The TAD (through-air-drying) technique is characterized by the fact that the "primary" fibrous web that leaves the sheet-making stage is pre-dried to a dry-solids content of e.g. about 80%, before final contact drying on the Yankee cylinder, by blowing hot air through the fibrous web. Pressing the "primary" fibrous web is hence not required for TAD processes. The fibrous web is supported by an air-permeable wire or belt and during its transport is guided over the surface of an air-permeable rotating cylinder drum. Structuring the supporting wire or belt makes it possible to produce any pattern of compressed zones broken up by deformation in the moist state, resulting in increased mean specific volumes and consequently leading to an increase in bulk softness without decisively decreasing the strength of the fibrous web. Such a pattern is fixed in the area of the TAD-cylinder. Thereafter the pattern is further imprinted between the TAD-fabric and the Yankee-cylinder.

Creping may be conducted also during transfer of the paper sheet from the forming wire directly to the TAD-fabric or via a transfer fabric. For this creping, the forming fabric runs faster than the following fabric receiving the sheet (rush transfer). For example, when applying the TAD technique for the production of base tissue and the usual double-screen sheet formation in c-wrap configuration, for example, the so-called inner sheet-forming screen can thus be operated at a speed that is up to 40% faster than that of the next fabric or that of the subsequent felt, the initially formed and already pre-drained paper web being transferred to the next TAD fabric. This causes the still moist and as a result plastically deformable paper web to be internally broken up by compression and shearing, thereby rendering it more stretchable under load than a paper that has undergone neither "internal" nor external creping. This transfer of still plastically deformable paper web at a differential speed that simultaneously takes effect may also be brought about in other embodiments between a transfer fabric and the so-called TAD imprinting fabric or between two transfer fabrics.

When processing ("converting") the base fibrous web or base tissue paper into the final product, the following procedural steps are normally used individually or in combination: cutting to size (longitudinally and/or cross cutting), producing a plurality of plies, producing chemical and/or mechanical (e.g. by embossing) ply adhesion, volumetric and structural embossing, laminating, folding, imprinting, perforating, application of lotions, smoothing, stacking, rolling up. Chemical ply adhesion can be performed by using an adhesive such as Kappasil and Kappaflex adhesives available from Kapp-Chemie GmbH.

To produce multi-ply tissue paper products, such as handkerchiefs, toilet paper, hand towels, household towels etc., an intermediate step can occur with so-called doubling in which the base tissue in the finished product's desired number of plies is usually gathered on a common multiply master roll.

The processing step from the base tissue, which has already been optionally wound up in several plies, to the finished product occurs in processing machines which include operations such as repeated smoothing of the tissue, edge embossing, to an extent combined with full area and/or local application of adhesive to produce ply adhesion of the individual plies (base tissue) to be combined together, as well as longitudinal cut, folding, cross cut, placement and bringing together a plurality of individual tissues and their packaging as well as bringing them together to form larger surrounding packages or bundles. The individual paper ply webs can also be pre-embossed and then combined in a roll gap according to the foot-to-foot or nested methods.

These converting techniques are known in the art.

Embodiments of the present invention are now further illustrated by the following examples.

4. Examples

The following test methods were used to evaluate the tissue papers produced. The test samples were conditioned for at least 12 hours at 50% relative humidity and 23° C. prior to testing.

4.1. Basis Weight

The basis weight was determined according to EN ISO 12625-6:2005, Tissue Paper and Tissue Products, Part 6: Determination of grammage.

4.2. Caliper

The measurement is made by a precision micrometer (precision 0.001 mm) according to a modified method based on EN ISO 12625-3:2014, Part 3. For this purpose, the distance created by a sample between a fixed reference plate and a parallel pressure foot is measured. The diameter of the pressure foot is 35.7+0.1 mm (10.0 $cm^2$ nominal area). The pressure applied is 2.0 kPa+0.1 kPa. The pressure foot is movable at a speed rate of 2.0+0.2 mm/s.

A usable apparatus is a thickness meter type L & W SE050 (available from Lorentzen & Wettre, Europe).

The base tissue (web) to be measured is cut into pieces of 20×25 cm and conditioned in an atmosphere of 23° C., 50% RH (Relative Humidity) for at least 12 hours. For the measurement, a stack of 10 base tissue paper sheets is prepared and placed beneath the pressure plate, which is then lowered. The thickness value for the stack is then read off 5 seconds after the pressure has been stabilized. The thickness measurement is then repeated nine times with further samples treated and prepared in the same manner.

The mean value of the 10 values is taken as thickness of 10 base tissue sheets measured (in the following referred to as "10-ply caliper").

The finished product to be measured (i.e. a one-ply or multi-ply tissue paper product) is cut into pieces of 20×25 cm and conditioned in an atmosphere of 23° C., 50% RH for at least 12 hours.

For the measurement one sheet is placed beneath the pressure plate which is then lowered. The thickness value for the sheet is then read off 5 seconds after the pressure has been stabilized. The thickness measurement is then repeated nine times with further samples treated in the same manner.

The mean value of the 10 values obtained is taken as thickness of one sheet ("one-sheet caliper") of the finished product (e.g. a two-ply hand towel) measured.

4.3. Bulk in $cm^3/g$

The bulk of the tissue paper was calculated with the following formula:

$$X=t/w$$

X=bulk ($cm^3/g$)

t=mean thickness of a sheet (μm)

w=basis weight of the sheets ($g/m^2$)

4.4 Dry Tensile Strength in N/m (MD+CD)

The dry strength was determined according to EN ISO 12625-4: 2005, Tissue Paper and Tissue Products, Part 4: Determination of width-related breaking strength, elongation at break and tensile energy absorption.

The tensile tester used for the measurement featured two clamps of 50 mm width. Each clamp can grip the test piece firmly, but without damage, along a straight line across the full width of the test piece (the clamping line). The distance between the clamping lines was set at 100 mm. For special tests, the distance is reduced if the available length of the sample is lower than 100 mm (e.g. toilet tissue in cross direction).

The tissue paper product to be measured, i.e. two sheets of a single-ply or multi-ply product, was cut into test pieces of 50 mm wide with parallel edges. Each sheet was cut into two different types of test pieces by cutting in the machine direction and in the cross direction. The obtained test pieces were then conditioned in an atmosphere of 23° C., 50% RH (Relative Humidity) for at least 12 hours.

The test piece to be measured was placed between the clamps without any strain, and such that any observable slack is eliminated. At the beginning, a pre-tensile force of 25 cN is applied (zero of stretch) then the elongation rate between the clamps was kept constant at 5 cm/min. The maximum tensile force required to break the test piece was obtained. The measurement was repeated with six test pieces and the values obtained were averaged.

The dry tensile strength was calculated by means of the following formula:

$$\text{Mean dry tensile strength [N/m]}=(\text{mean maximum tensile force [N]}/\text{initial width of the test piece [mm]})\times 10^3$$

Results were reported separately for the machine direction (MD) and the cross direction (CD).

4.5. Wet Tensile Strength in N/50 mm (MD+CD)

The wet strength was determined according to EN ISO 12625-5:2005 Tissue Paper and Tissue Products, Part 5: Determination of wet tensile strength.

The apparatus used for the measurement was a vertical tensile strength tester featuring one clamp of 50 mm width, capable of gripping the test piece firmly without slippage. Below the clamp a thin metal bar and further below a vertically movable Finch Cup soaking device filled with water was arranged as is well known in the art.

To prepare the test pieces two sheets of a single-ply or multi-ply paper were each cut into test "strips" of 5×15 cm with parallel edges. From each sheet two types of test pieces were prepared by cutting in the machine direction (MD) and in the cross direction (CD).

To ensure that the wet strength of the samples had fully developed, the samples to be tested were artificially aged before conducting the tensile test measurement. Aging was achieved by heating the samples in an air-circulating drying cabinet to 80° C. for a period of 30 min according to the ISO standard.

For the test, the strip-shaped test piece was wound once around the metal bar in the Finch Cup soaking device in order to form a loop followed by fixing both ends of the test piece loop in the clamp arranged above the soaking device. The two ends of the test piece were fixed in the clamp without any strain, and such that the test span was set at 4.5 cm. To start the measurement the Finch cup filled with water was raised so that the bar and the strip are fully immersed in the water. After that the test piece was soaked for 15 seconds followed by immediately initiating the tensile test. The wet tensile force required to break the immersed test piece was determined at an elongation rate of 5 cm/min. The measurement was repeated with six test pieces and the values obtained were averaged.

The wet tensile strength was then calculated with the following formula:

$$\text{Mean wet tensile strength [N/m]}=(\text{mean maximum tensile force [N]}/\text{initial width of the test piece [mm]})\times 10^3$$

Results were reported separately for the machine direction (MD) and the cross direction (CD).

4.6. Geometrical Mean Tensile Index (Dry)

The geometrical mean tensile index was calculated in accordance with EN ISO 12625-4:2005 by the following formula:

$$\text{Geometrical Mean Tensile Index [Nm/g]}=\text{SQRT}((\text{Tensile Strength MD [N/m]}\times\text{Tensile Strength CD [N/m]})/(\text{Basis Weight [g/m}^2\text{]})^2)$$

The basis weight of the tissue paper was determined in accordance with EN ISO 12625-6, Tissue Paper and Tissue Products, Part 6: Determination of grammage, as set forth in item 4.1 above.

4.7. Freeness Value

The freeness value (in °SR) was measured according to DIN-ISO 5267/1; March 1999.

4.8. Softness

Softness was rated by a panel composed of at least five qualified persons.

The final tissue paper product (i.e. three-ply toilet paper, two-ply hand towel or two-ply household towel) is compared against softness standards. The evaluation procedure consists in assessing surface and bulk softness, grip and drapability. By judgment of the panelist the tested products are ranked against standards with a known softness value. The results of the individual panelists are averaged into a final softness value for the respective finished product.

Very slight differences in tissue softness can thus be quantified by comparison with tissue references to which softness values ranging from 1.5 to 4.0 had been previously allocated. Softness ratings were averaged across all panelists.

4.9. Absorption

The absorption (in g/g) was determined in accordance with PrENV 12625-8 Tissue Paper and Tissue Products, Part 8: Determination of water-absorption time and water-absorption capacity, in accordance with the basket-immersion test method described in EP 1 362 143 B1, item 5—test method and FIG. 1).

4.10. Starting Materials, Chemicals and Tissue Machine

Pulp

Three different types of pulp fibers were used as follows:

Northern Bleached Softwood Kraft (NBSK) Pulp from Canfor Pulp Ltd., ECF 90 pulp grade ("SW pulp")

Chemical pulp made from Eucalyptus hardwood fibers from Suzano Pulp and Paper, Brazil; Extra Prime Bleached Eucalyptus Kraft Pulp ECF grade ("HW pulp")

Chemical pulp produced by SCA Hygiene Products from *Miscanthus giganteus* ("MG pulp").

The "MG pulp" was produced using the soda pulping process. Soda pulping uses NaOH as the active cooking chemical to achieve the delignification which occurs at elevated temperatures. After the cooking, the pulp was bleached using conventional bleaching agents and dried.

Chemicals

The chemicals used in the following examples are listed below:

For the Yankee coating:

Adhesive 2624 from Buckman;

Plasticizer 2616 from Buckman;

Release agent 2098e from Buckman

Wet strength resin Kymene™ 557 H from Ashland (12.5% solids).

Adhesives: Kappasil 260-4410, Kappaflex binder 72-0004. and Kappaflex grau 65-0012 were each purchased from Kapp-Chemie GmbH, Germany.

Hereinafter weight proportions ("kg/t") always refer to the amount of treated cellulosic fibers (dry weight).

Tissue Machine

A conventional tissue paper making machine was adapted to make a three-ply toilet paper (Example 1), a two-ply hand towel (Example 2) and a two-ply household towel (Example 3). The machine was equipped with a Dry Crepe configuration and involved a two-layer headbox; a Crescent Former; a Suction Turning Roll; a NipcoFlex-T shoe press; a Yankee dryer with a drying hood; and a reel section to wind up the tissue paper.

The machine settings were kept throughout the trials in the following range(s):

Yankee speed: 1000 m/min

Shoe press line load: 90 kN/m

Creping factor: 13%

Dryness before Yankee: 42 to 48%

Hood temperature: 190-330° C.

Final tissue dryness: 94-97%

Example 1-1 (Reference Toilet Paper)

To achieve the desired finished toilet tissue paper one-ply base tissue was combined in a subsequent converting step to the final ply count (3). All three plies were produced in the same manner as described below:

The first furnish stream was prepared from unrefined HW pulp.

Then, SW pulp was refined to a freeness value of 21°SR to prepare a second furnish stream.

These two furnishes were supplied to the two chambers of a two-layer headbox. The furnish streams were kept separate through the headbox and deposited between a forming wire and a felt to form a two layer embryonic web containing 40 wt.-% of the refined SW pulp and 60 wt.-% of the unrefined HW pulp, respectively.

The embryonic web was dewatered in the shoe press to a dryness of about 42 to 48% and then led over the Yankee cylinder such that the HW pulp layer was in contact with the surface of the Yankee cylinder ("Y") and the SW pulp layer was opposite the Hood ("H").

After drying and creping, three two-layer base tissue paper webs having each a basis weight of about 17 g/m$^2$ and a 10-ply caliper of about 1.25 mm were obtained.

These three paper webs were bonded to each other by decor laminating/embossing and cut to size.

In the decor laminating/embossing step the three webs were fed through the nip of an embossing station including an embossing roll with protrusions forming a micro background and design elements (feathers) and a rubber roll arranged opposite thereto. Technical solutions where décor and background embossing are created by separate rolls/nips may be utilized too. Before the middle ply reached the nip, and after being superimposed with one outer web (ply), adhesive was selectively applied to those areas of the middle web (ply) that are joined together in the nip with the corresponding areas of the two outer webs (plies) by means of the protruding design elements of the embossing roll.

The adhesive used for bonding the three paper webs together was composed of 49 wt.-% water (452.16 kg), 46 wt.-% Kappasil (260-4410) (422.40 kg), 4.5 wt.-% Kappaflex binder (72-0004) (43.20 kg), and 0.5 wt.-% Kappaflex grau (65-0012) (4.42 kg), based on the total weight (922.18 kg) of the adhesive.

The three webs were fed to the embossing station and bonded in such a manner that the HW pulp layers (produced from the first furnish) of the two outer webs (plies) were located each on the outside of the three-ply toilet paper.

Example 1-2 (Toilet Paper with 12% MG Pulp)

A three-ply toilet paper was produced in the same manner as set forth in Example 1-1 apart from the following differences.

The first furnish stream was a ¼ mixture of unrefined MG pulp and unrefined HW pulp, respectively.

The SW pulp used for the second furnish stream was refined to a slightly higher freeness value of 22°SR.

In the manufacture of the resulting two-layer webs, the SW pulp layer (40%) was located on the hood side, while the layer on the Yankee side included 12% MG pulp and 48% HW pulp, each based on the total weight of the web.

These three paper webs were bonded to each other by decor laminating/embossing and cut to size in the same manner as described in Example 1-1. They were bonded in such a manner that the MG pulp-containing layers (produced from the first furnish stream) of the two outer webs (plies) were located each on the outside of the three-ply toilet paper.

Example 1-3 (Toilet Paper with 60% MG Pulp)

A three ply toilet paper was produced in the same manner as set forth in Example 1-1 apart from the following difference:

The first furnish stream contained only unrefined MG pulp.

In the manufacture of the resulting two-layer webs, the SW pulp layer (40%) was located on the Hood side ("H"), while the layer on the Yankee side ("Y") included 60% MG pulp, each based on the total weight of the web.

These three paper webs were bonded to each other by decor laminating/embossing and cut to size size in the same manner as described in Example 1-1. They were bonded in such a manner that the MG pulp-containing layers of the two outer webs (plies) were located each on the outside of the three-ply toilet paper.

The properties of the toilet papers obtained in examples 1-1, 1-2 and 1-3 were evaluated according to the procedures explained hereinbefore. The results were as shown in table 1 below.

TABLE 1

| | Example 1-1 (Reference) | Example 1-2 | Example 1-3 |
|---|---|---|---|
| Pulp composition of plies (Y/H) | 60% HW/ 40% SW | (12% MG + 48% HW)/40% SW | 60% MG/ 40% SW |
| Total basis weight (g/m$^2$) | 51.9 | 49.0 | 48.6 |
| Caliper/sheet[1] (μm) | 480 | 460 | 460 |
| Bulk (cm$^3$/g) | 9.25 | 9.39 | 9.47 |
| Dry MD tensile (N/m) | 238 | 236 | 274 |
| Dry CD tensile (N/m) | 124 | 128 | 136 |
| Geometrical Mean Tensile Index (Nm/g) | 3.3 | 3.5 | 4.0 |
| Softness | 2.2 | 2.2 | 2.1 |
| Absorption | 8.4 | 8.6 | 8.5 |

[1]"one sheet caliper" as described before

These test data show that the use of MG chemical pulp fibers according to embodiments of the present invention can lead to a major absolute increase in tensile strength without concomitant loss of softness, or with only a minor loss of softness.

Further, it was surprisingly observed that, during the final drying and creping steps of the process, the embryonic fibrous webs of Examples 1-2 and 1-3, which contained MG pulp fibers, showed a better adhesion to the Yankee cylinder than the web of Reference Example 1-1, which contained eucalyptus pulp fibers instead.

Example 2-1 (Reference Hand Towel)

Two tissue paper plies were produced as described below.

SW pulp was refined to a freeness value of 21°SR and two different pulp slurries (furnishes) were prepared:

The first furnish stream was a 1/1 mixture of refined SW pulp and unrefined HW pulp, respectively.

The second furnish stream contained only refined SW pulp.

5.0 kg/t of Kymene™ 557H, based on the total pulp amount, was added to the first and second furnish streams.

These two furnish streams were supplied to the two-layer headbox. The furnish streams were kept separate through the headbox and deposited onto a Fourdrinier wire to form a two-layer embryonic web containing 50 wt.-% of refined SW pulp, and 50 wt.-% of the aforementioned 1/1 mixture of refined SW pulp and unrefined HW pulp.

The embryonic web was dewatered in the shoe press to a dryness of about 42 to 48% and then led over the Yankee cylinder such that the first furnish was in contact with the surface of the Yankee cylinder and the second furnish (SW pulp only) opposite the Hood.

Two two-layer base tissue paper webs having each a basis weight of about 21 g/m$^2$ and a 10-ply caliper of about 1.37 mm were obtained and wound up on jumbo rolls.

These two paper webs were bonded together by decor laminating/embossing, cut to size and reeled-up to a dispenser hand towel dispenser.

In the decor laminating/embossing step the two webs were fed through the nip of an embossing station including an embossing roll with protrusions forming a micro background and design elements (leaf and Tork® logo) and a rubber roll arranged opposite thereto. Before one web (ply) reached the nip, adhesive was selectively applied to those areas thereof that are joined together in the nip with the corresponding areas of the other web (ply) by means of the protruding design elements of the embossing roll.

The adhesive used for bonding the two paper webs together was the same as used in Example 1-1.

In the bonding step, the webs were superimposed and fed to the embossing station in such a manner that the layers containing only softwood pulp contacted each other and were located inside the two-ply hand towel (as shown in the table below).

| | layer | Pulp composition | Kymene |
|---|---|---|---|
| 1$^{st}$ ply | Outer [1)] | 25% SW + 25% HW | Yes |
| | Inner [2)] | 50% SW | Yes |
| 2$^{nd}$ ply | Inner [2)] | 50% SW | Yes |
| | Outer [1)] | 25% SW + 25% HW | Yes |

[1)] produced from 1$^{st}$ furnish/
[2)] produced from 2$^{nd}$ furnish

Example 2-2 (Hand Towel with 10% MG Pulp)

A two-ply hand towel was produced in the same manner as set forth in Example 2-1 apart from the following difference:

The first furnish stream contained a 2/3/5 mixture of unrefined MG pulp, unrefined HW pulp and refined SW pulp, respectively.

Further, in accordance with the procedure of Example 2-1, the second furnish stream contained only refined SW pulp.

5.0 kg/t of Kymene™ 557H, based on the total pulp amount, was added to the first and second furnish streams.

In the manufacture of the resulting two-layer webs, the SW layer (50%) was on the hood side, while the layer on the Yankee side included 10% MG, 15% HW and 25% SW pulp, each based on the total weight of the ply.

Two two-layer base tissue paper webs having each a basis weight of about 21 g/m$^2$ and a 10-ply caliper of about 1.20 mm were obtained and wound up on jumbo rolls.

These two paper webs were bonded together by decor lamination/embossing, cut to size and reeled-up in the same manner as described in in Example 2-1. Correspondingly, in the final two-ply hand towel, the layers containing only softwood pulp contacted each other and the MG pulp-containing layers (produced from the first furnish) were located on the outside (as shown in the table below).

| | layer | Pulp composition | Kymene |
|---|---|---|---|
| 1st ply | Outer 1) | 10% MG + 15% HW + 25% SW | Yes |
| | Inner 2) | 50% SW | Yes |
| 2nd ply | Inner 2) | 50% SW | Yes |
| | Outer 1) | 10% MG + 15% HW + 25% SW | Yes |

1) produced from 1st furnish/
2) produced from 2nd furnish

Example 2-3 (Hand Towel with 25% MG Pulp)

The two webs constituting the two plies of a two ply hand towel were produced as described below.

A first web and a second web were produced in the same manner as explained in Example 2-1 apart from the following differences:

The first furnish stream was a 1/1 mixture of refined SW pulp and unrefined MG pulp, respectively.

Further, in accordance with the procedure of Example 2-1, the second furnish stream contained only refined SW pulp.

5.0 kg/t of Kymene™ 557H, based on the total pulp amount, was added to the first and second furnish streams.

The two furnish streams were kept separate through the headbox and deposited onto a Fourdrinier wire in such a ratio so as to form a two-layer embryonic web containing 75 wt.-% of refined SW pulp and 25 wt.-% of MG pulp, each based on the total amount of pulp (=total weight of the web).

In the manufacture of the resulting webs, the SW pulp layer (50%) was on the Hood side, while the layer on the Yankee side included 25% SW+25% MG, each based on the total weight of the web.

The first and second base tissue paper web each had a basis weight of about 21 g/m$^2$ and a 10-ply caliper of about 1.20 mm and were wound up separately on jumbo rolls.

The first paper web and the second paper web were bonded together by decor lamination/embossing, cut to size and wound on a dispenser hand towel reel in the same manner as described in in Example 2-1.

In the final two-ply hand towel, the layers containing only softwood pulp contacted each other and the MG pulp-containing layers were located on the outside (as shown in the table below).

| | layer | Pulp composition | Kymene |
|---|---|---|---|
| 1st ply | Outer 1) | 25% SW + 25% MG | Yes |
| | Inner 2) | 50% SW | Yes |
| 2nd ply | Inner 2) | 50% SW | Yes |
| | Outer 1) | 25% SW + 25% MG | Yes |

1) produced from first furnish/
2) produced from 2nd furnish

The properties of the hand towels obtained in examples 2-1, 2-2 and 2-3 were evaluated according to the procedures explained hereinbefore. The results were as shown in table 2 below.

TABLE 2

| | Example 2-1 (Reference) | Example 2-2 | Example 2-3 |
|---|---|---|---|
| Pulp composition of plies (Y/H) | (25% SW + 25% HW)/ 50% SW | (10% MG + 15% HW + 25% SW)/ 50% SW | (25% SW + 25% MG)/ 50% SW |

TABLE 2-continued

| | Example 2-1 (Reference) | Example 2-2 | Example 2-3 |
|---|---|---|---|
| Total basis weight (g/m$^2$) | 42.8 | 40.0 | 41.4 |
| Caliper/sheet[1] (μm) | 250 | 260 | 260 |
| Bulk (cm$^3$/g) | 5.84 | 6.,50 | 6.28 |
| Dry MD tensile (N/m) | 615 | 759 | 751 |
| Dry CD tensile (N/m) | 321 | 323 | 349 |
| Geometrical Mean Tensile Index (Nm/g) | 10.4 | 12.4 | 12.4 |
| Absorption (g/g) | 6.4 | 6.2 | 6.5 |

1."one sheet caliper" as described before

These test data show that the use of MG chemical pulp fibers according to embodiments of the present invention can lead to an absolute increase in tensile strength, when compared to HW pulp fibers, e.g. Eucalyptus.

Further, it was also surprisingly observed that, during the final drying and creping steps of the process, the embryonic fibrous webs of Examples 2-2 and 2-3 which contained MG pulp fibers showed a better adhesion to the Yankee cylinder than the web of Reference Example 2-1 which contained eucalyptus pulp fibers instead.

Example 3-1 (Reference Household Towel)

The same tissue paper webs as produced in Example 2-1 were used for manufacturing a two-ply household towel. The two tissue paper webs were superimposed and bonded (laminated) to each other by embossing in a nested configuration.

In the laminating/embossing step the two webs were fed through the nip of an embossing station including an embossing roll with protrusions forming a graphical pattern and a rubber roll arranged opposite thereto. Before one web (ply) reached the nip, the same adhesive as described in Example 1-1 was selectively applied to those areas of the web that are joined together in the nip with the corresponding areas of the other web (ply) by means of the protruding elements of the embossing roll.

Example 3-2 (Household Towel with 10% MG Pulp)

The same tissue paper webs as produced in Example 2-2 were used for manufacturing a two-ply household towel. The two tissue paper webs were laminated and embossed in the same manner as described in Example 3-1.

Example 3-3 (Household Towel with 25% MG Pulp)

The same tissue paper webs as produced in Example 2-3 were used for manufacturing a two-ply household towel. The two tissue paper webs were laminated and embossed in the same manner as described in Example 3-1.

The properties of the household towels obtained in examples 3-1, 3-2 and 3-3 were evaluated according to the procedures explained hereinbefore. The results were as shown in table 3 below.

TABLE 3

| | Example 3-1 (Reference) | Example 3-2 | Example 3-3 |
|---|---|---|---|
| Pulp composition of plies (Y/H) | (25% SW + 25% HW)/ 50% SW | (10% MG + 15% HW + 25% SW)/ 50% SW | (25% SW + 25% MG)/ 50% SW |
| Total basis weight (g/m$^2$) | 41.4 | 39.3 | 42.1 |
| Caliper/sheet[1] (μm) | 710 | 720 | 720 |
| Bulk (cm$^3$/g) | 17.15 | 18.32 | 17.10 |
| Dry MD tensile (N/m) | 453 | 577 | 612 |
| Dry CD tensile (N/m) | 190 | 191 | 237 |
| Geometrical Mean Tensile Index (Nm/g) | 7.1 | 8.4 | 9.0 |
| Softness | 5.,5 | 5.4 | 4.9 |
| Absorption (g/g) | 10.5 | 10.6 | 9.7 |

[1]"one sheet caliper" as described before

These test data show that the use of MG pulp fibers according to embodiments of the present invention can lead to an absolute increase in tensile strength without significant loss of softness.

Further, it was surprisingly observed that, during the final drying and creping steps of the process, the embryonic fibrous webs of Examples 3-2 and 3-3 which contained MG pulp fibers showed a better adhesion to the Yankee cylinder than the web of Reference Example 3-1 which contained eucalyptus pulp fibers instead.

The invention claimed is:

1. A tissue paper web composed of one or more layers, wherein at least one layer comprises a combination of primary wood pulp fibers and pulp fibers originating from *Miscanthus giganteus*, wherein the pulp fibers originating from *Miscanthus giganteus* are selected from the group consisting of chemical pulp fibers, mechanical pulp fibers subjected to a chemical pretreatment, and mixtures thereof.

2. The tissue paper web according to claim 1, wherein the pulp fibers originating from *Miscanthus giganteus*, are present in an amount of at least 5 wt.-%, based on the total weight of the tissue paper web.

3. The tissue paper web according to claim 1, wherein the web is composed of two or three layers made from different pulps wherein at least one of these layers is made from pulp comprising the combination of primary wood pulp fibers and pulp fibers originating from *Miscanthus giganteus*.

4. The tissue paper web according to claim 3, wherein the web is composed of two layers wherein:

(i) the first layer is made from pulp fibers consisting of, fibers originating from *Miscanthus giganteus*, softwood fibers, and optionally hardwood fibers, and (ii) a second layer is made from pulp fibers comprising, or consisting, of softwood fibers.

5. The tissue paper web according to claim 4, wherein the weight ratio MG/HW/SW in %, based on the total weight of pulp fibers in the first layer, is 10 to 90/0 to 50/10 to 90, and wherein the weight proportion of pulp fibers originating from *Miscanthus giganteus*, based on the total weight of the tissue paper web is 10 to 50 wt-%.

6. The tissue paper web according to claim 1, wherein other fibers present in said tissue paper web include hardwood fibers, softwood fibers or non-wood fibers.

7. The tissue paper web according to claim 1, wherein:

(i) the first layer is made from pulp fibers consisting of fibers originating from *Miscanthus giganteus* and hardwood fibers, wherein the weight ratio of fibers originating from *Miscanthus giganteus*, to hardwood fibers is 90/10 to 10/90, and wherein the weight proportion of pulp fibers originating from *Miscanthus giganteus*, based on the total weight of the tissue paper web is 10 to 90 wt. %.

8. The tissue paper web according to claim 7, wherein the hardwood pulp fibers originate from eucalyptus and/or the softwood pulp fibers are Northern Bleached Softwood Kraft (NBSK) fibers.

9. The tissue paper web according to claim 1, wherein the pulp fibers originating from *Miscanthus giganteus* are obtained in a chemical, chemo-mechanical, or high yield chemical pulping process.

10. The tissue paper web according to claim 1, wherein (i) all fibers present in the web are primary pulp fibers, or (ii) a mixture of primary and secondary (recycled) pulp fibers wherein the proportion of secondary (recycled) pulp fibers does not exceed 90 wt.-% based on the tissue paper web.

11. The tissue paper web according to claim 1, wherein the pulp fibers originating from *Miscanthus giganteus* fulfill the following requirements:

(i) average fiber length of from 0.5 to 1.2 mm;

(ii) average fiber diameter of from 10 to 25 μm; and (iii) average fiber wall thickness of from 3.0 to 5.0 μm.

12. A tissue paper product comprising at least one ply made from the tissue paper web according to claim 1.

13. The tissue paper product according to claim 12, wherein the tissue paper product is selected from the group consisting of toilet paper, hand towel, household towel, handkerchiefs, napkins, and facial tissues.

14. The tissue paper product according to claim 12, wherein the tissue paper product is a toilet paper composed of 2 to 5 plies, wherein at least one outer ply is made from the tissue paper web, wherein (i) the first layer is made from pulp fibers consisting of fibers originating from *Miscanthus giganteus* and hardwood fibers, wherein the weight ratio of fibers originating from *Miscanthus giganteus*, to hardwood fibers is 90/10 to 10/90, and (ii) the second layer is made from pulp comprising, or consisting of, softwood fibers, and wherein the weight proportion of pulp fibers originating from *Miscanthus giganteus*, based on the total weight of the tissue paper web is 10 to 90 wt. %, and wherein the at least one outer ply is arranged such that, in the toilet paper, the first layer thereof (i) is located on the outer surface of the toilet paper.

15. The tissue paper product according to claim 12, wherein the tissue paper product is a hand towel or household towel composed of 2 to 5 plies, wherein at least one ply is made from the tissue paper web, wherein (i) the first layer is made from pulp fibers consisting of fibers originating from *Miscanthus giganteus* and hardwood fibers, wherein the weight ratio of fibers originating from *Miscanthus giganteus*, to hardwood fibers is 90/10 to 10/90, and (ii) the second layer is made from pulp comprising, or consisting of, softwood fibers, and wherein the weight proportion of pulp fibers originating from *Miscanthus giganteus*, based on the total weight of the tissue paper web is 10 to 90 wt. %.

16. The tissue paper product according to claim 12, wherein the tissue paper product is free of a softener, is free of a strengthening resin, or is free of both a softener and a strengthening resin.

17. A process for the manufacture of the tissue paper web according to claim 1, comprising:

(a) providing chemical pulp fibers comprising primary wood fibers and fibers originating from *Miscanthus gigantheus;*

(b) forming an aqueous suspension of said pulp fibers;

(c) feeding the suspension to a tissue-making headbox;

(d) depositing the suspension onto a wire to form a wet web;

(e) dewatering the wet web; and (f) drying and creping the web.

* * * * *